US008217254B2

(12) United States Patent
Zoran et al.

(10) Patent No.: US 8,217,254 B2
(45) Date of Patent: Jul. 10, 2012

(54) DIGITAL INSTRUMENT WITH PHYSICAL RESONATOR

(75) Inventors: Amit Shlomo Zoran, Cambridge, MA (US); Marco Luigi Coppiardi, Boston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 127 days.

(21) Appl. No.: 12/478,697

(22) Filed: Jun. 4, 2009

(65) Prior Publication Data

US 2010/0307313 A1 Dec. 9, 2010

(51) Int. Cl.
*G10H 1/32* (2006.01)

(52) U.S. Cl. ..... 84/743; 84/184; 84/185; 84/187; 84/188; 84/189; 84/190; 84/192; 84/270; 84/277; 84/280; 84/294; 84/410; 84/718

(58) Field of Classification Search ..... None
See application file for complete search history.

(56) References Cited

U.S. PATENT DOCUMENTS

| | | | | |
|---|---|---|---|---|
| 423,001 | A | 10/1980 | Wellings | |
| 441,118 | A | 10/1983 | Faivre | |
| 534,790 | A | 9/1994 | Lawrence | |
| 546,119 | A | 10/1995 | Schertler | |
| 5,900,562 | A * | 5/1999 | Smeding | 84/385 P |
| 594,561 | A | 8/1999 | White | |
| 604,639 | A | 4/2000 | Saul | |
| 618,800 | A1 | 2/2001 | White | |
| 619,464 | A1 | 2/2001 | Hendrickson | |
| 652,542 | A1 | 2/2003 | Erismann | |
| 691,159 | A1 | 6/2005 | Childress | |
| 700,206 | A1 | 2/2006 | Petersen | |
| 7,151,210 | B2 * | 12/2006 | Janes et al. | 84/291 |
| 744,286 | A1 | 10/2008 | Moghaddam | |
| 751,461 | A1 | 4/2009 | McGrew | |
| 7,514,614 | B2 * | 4/2009 | McGrew | 84/291 |
| 7,538,269 | B2 * | 5/2009 | Ekstrom | 84/743 |
| 2003/0015086 | A1 * | 1/2003 | Katz | 84/644 |
| 2004/0060417 | A1 * | 4/2004 | Janes et al. | 84/291 |
| 2007/0028752 | A1 * | 2/2007 | McGrew | 84/726 |
| 2008/0028911 | A1 * | 2/2008 | DiSanto | 84/294 |
| 2008/0105101 | A1 * | 5/2008 | Eldring | 84/291 |
| 2010/0031800 | A1 * | 2/2010 | Ekstrom | 84/291 |

* cited by examiner

*Primary Examiner* — Marlo Fletcher
(74) *Attorney, Agent, or Firm* — Stephen Otis

(57) ABSTRACT

In an implementation of this invention, a stringed musical instrument has a resonator comprised of a bridge and a soundboard. Vibrations from the strings are transmitted through the bridge to the soundboard. A plurality of sensors are attached to or embedded in the soundboard. The sensors measure primarily the vibrations of the soundboard, rather than primarily the vibrations of the strings. Preferably, three or more sensors are used. Piezoelectric sensors sample vibrations in the soundboard. The resonator includes a printed circuit board that amplifies the signal from each sensor separately. Also, a signal processing device that is "onboard" the musical instrument processes the separate input signals to create one output signal. The resonator may be easily removed, enabling resonators to be interchanged. Also, the physical characteristics of a particular resonator, such as its mass or its boundary condition, may be adjusted, thereby changing the acoustic qualities of the soundboard.

20 Claims, 25 Drawing Sheets

DIGITAL INSTRUMENT WITH PHYSICAL RESONATOR

FIELD OF THE INVENTION

This invention relates to stringed musical instruments.

SUMMARY OF THE INVENTION

In an implementation of this invention, a stringed musical instrument has a resonator comprised of a bridge and a soundboard. Vibrations from the instrument's strings are transmitted through the bridge to the soundboard. Sensors are attached to or embedded in the soundboard, and detect vibrations of the soundboard.

It is highly desirable for the sensors to measure primarily the vibrations of the soundboard, as opposed to primarily the vibrations of the strings. The acoustic signal created by a vibrating soundboard is different from, and in many cases has a richer timbre than, an acoustic signal produced by vibrating strings. For example, a vibrating wooden soundboard creates a richer tone than vibrating stings alone. Moreover, because a vibrating acoustic soundboard is typically louder than the strings that cause it to vibrate, the characteristic sound of an acoustic stringed instrument is predominantly created by the soundboard, not the strings. If one measures primarily the vibrations of the strings, this rich, characteristic sound is lost.

In a preferred implementation of this invention, the sensors measure primarily the vibrations of the soundboard. This is quite different than conventional pickups on an electric guitar, which measure vibrations of the strings.

It is also highly desirable to have at least three such sensors. Different parts of a soundboard vibrate differently, particularly in a non-homogenous material such as wood. The overall effect of these differently vibrating parts is to create the rich tonal quality of the soundboard. In a preferred implementation of this invention, multiple sensors sample modes of vibrations in different places in the soundboard, thereby capturing the richer spectral response of wood. The number of sensors may vary. Ideally, vibrations would be sampled at all the points of a soundboard, requiring an infinite number of sensors. However, sampling with sensors located in at least three places is sufficient for most purposes, given the limitations of human hearing. In a preferred embodiment of this invention, three or more sensors are used to sample vibrations in different places on the soundboard.

In an implementation of this invention, the vibrating strings drive the resonator's bridge. The bridge transmits these vibrations to the soundboard, causing it to vibrate. Five piezoelectric sensors sample vibrations in the soundboard. The resonator includes a PCB (printed circuit board) that amplifies the signal from each sensor separately (using op-amp and trimming potentiometer apparatus). A SP (signal processing) device processes the five input signals to create one output signal.

It is an advantage of this invention that, in many implementations, the resonator may be easily inserted and removed through the back side of the musical instrument (i.e, the side opposite the strings). This is desirable because the strings do not need to be moved or loosened in order to insert and remove a resonator. The ease of insertion and removal makes it practicable to replace one resonator with another.

This invention gives the user great flexibility to adjust the acoustic qualities of the soundboard. These adjustments are achieved by changing physical characteristics of the soundboard, and thus changing its sound. This physical flexibility complements the flexibility and control made possible with signal processing. For example, in various implementations of this invention, a soundboard may be adjusted with apparatus for changing the material composition, boundary conditions or bracing of the soundboard or for adding or removing mass at different locations on the soundboard. Alternately, flexibility may be achieved by removing a particular soundboard and replacing it with another soundboard with different physical features and thus different tonal qualities. In a preferred embodiment of this invention, the resonator may be easily inserted and removed, thereby facilitating the interchange of resonators.

This invention applies to any musical instrument with one or more strings. For example, it may be implemented for a guitar, any member of the violin family or a piano.

The preceding summary provides a simplified introduction to some aspects of the invention, but is not intended to define the scope of the invention.

BRIEF DESCRIPTION OF THE DRAWINGS

In the detailed description which follows, reference will be made to the attached drawings.

Figure 1:
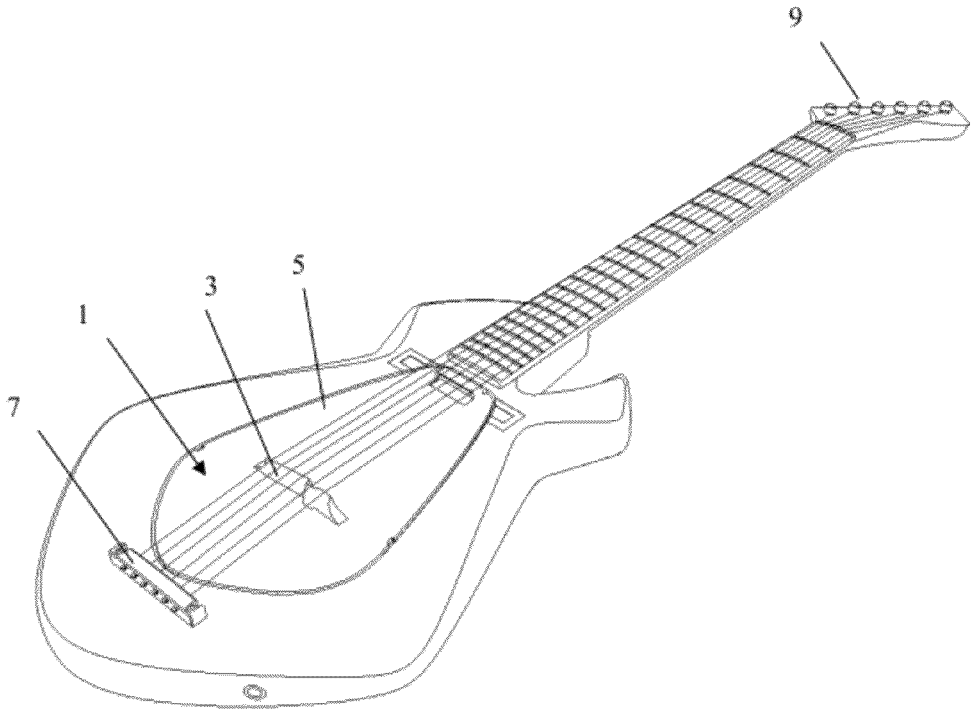
FIG. 1 is a perspective view of a guitar embodying principles of the invention.

The preceding drawings illustrate some ways in which the principles of the invention may be implemented, but are not intended to limit the scope of the invention.

DETAILED DESCRIPTION

Before describing this invention, it is helpful to first briefly discuss soundboards, which are also called a sounding board, belly or plate in some instruments. Examples of soundboards include the front side of an acoustic guitar, the face plate of a violin, or a sounding board beneath the strings in a grand piano. In many stringed musical instruments, the strings are not able to create a sufficiently loud sound by themselves. To increase loudness, the vibrations of the strings are transmitted through a bridge to a soundboard, causing the soundboard to vibrate. Because the soundboard has a larger surface area than the strings, it can move a larger volume of air, producing a louder sound.

In an implementation of this invention, a stringed musical instrument has a resonator comprised of a bridge and a soundboard. Vibrations of the instrument's strings are directly or indirectly transmitted through the bridge to the soundboard. A plurality of sensors are attached to or embedded in the soundboard, and detect vibrations of the soundboard.

It is highly desirable for the sensors to measure primarily the vibrations of the soundboard, as opposed to primarily the vibrations of the strings. The acoustic signal created by a vibrating soundboard is different from, and in many cases has a richer timbre than, an acoustic signal produced by vibrating strings. For example, a vibrating wooden soundboard creates a richer tone than vibrating stings alone. Moreover, because a vibrating acoustic soundboard is typically louder than the strings that cause it to vibrate, the characteristic sound of an acoustic stringed instrument is predominantly created by the soundboard, not the strings. If one measures primarily the vibrations of the strings, this rich, characteristic sound is lost.

In a preferred implementation of this invention, the sensors measure primarily the vibrations of the soundboard. This is quite different than conventional pickups on an electric guitar, which measure vibrations of the strings.

It is also highly desirable to have at least three such sensors. Different parts of a soundboard vibrate differently, particularly in a non-homogenous material such as wood. The overall effect of these differently vibrating parts is to create the rich tonal quality of the soundboard. In a preferable implementation of this invention, multiple sensors sample modes of vibrations in different places in the soundboard, thereby capturing the richer spectral response of wood. The number of sensors may vary. Ideally, vibrations would be sampled at all the points of a soundboard, requiring an infinite number of sensors. However, sampling with sensors located in at least three places is sufficient for most purposes, given the limitations of human hearing. In a preferred embodiment of this invention, three or more sensors are used to sample vibrations in different places on the soundboard.

This invention may be implemented in any stringed musical instrument.

FIG. 1 is a perspective view of a guitar embodying principles of the invention. A resonator 1 comprised of a bridge 3 and soundboard 5. The guitar strings are connected to the tailpiece 7 and machine heads 9. The guitar strings exert pressure against the bridge, tending to hold the resonator in position against the resonator tray assembly.

Figure 2:
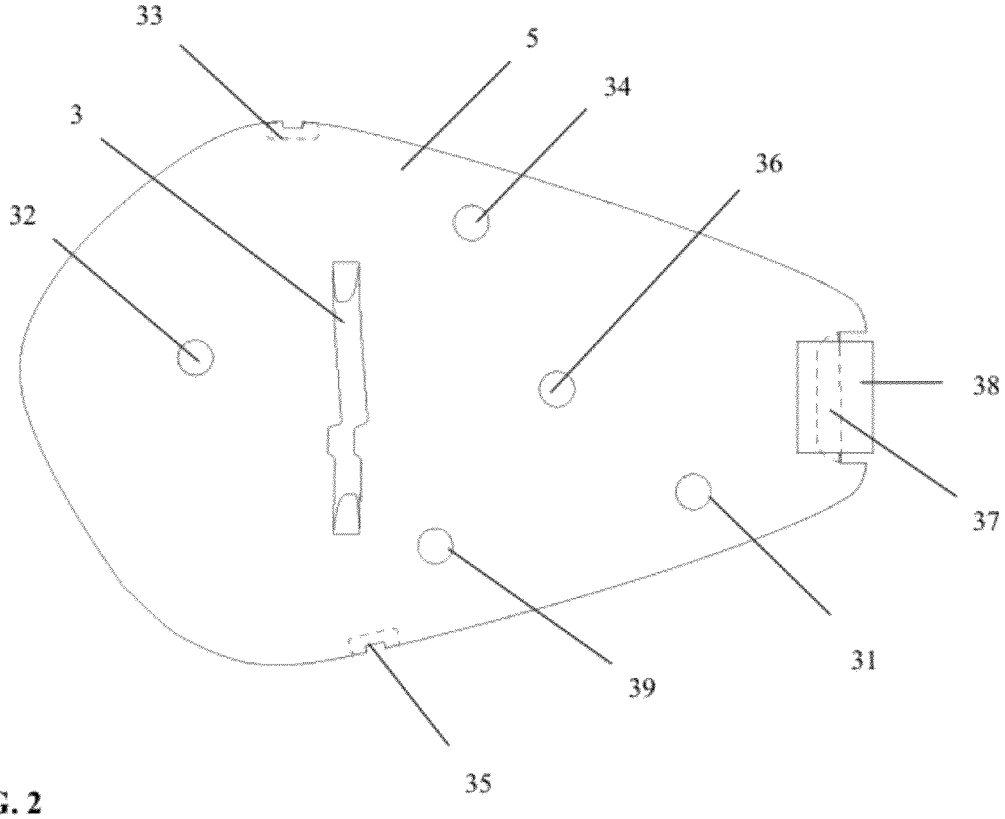
FIG. 2 is a top view of a resonator for such guitar, embodying principles of the invention.

FIG. 2 is a top view of a resonator for such guitar, embodying principles of the invention. The resonator is comprised of a bridge 3 and soundboard 5. In this implementation, the resonator has five piezoelectric sensors 31, 32, 34, 36, 39 for measuring primarily vibrations in the soundboard. The sensors are embedded in the soundboard. They detect vibrations of the soundboard in their respective locations, thereby sampling vibrations in five different points of the soundboard. The soundboard rests on three supports 33, 35 and 37 that simply support the soundboard. The strings exert force on the bridge. This force is transmitted through the bridge and pushes the soundboard against the three supports, holding the resonator in place. A PCB (printed circuit board) 38 is attached to the soundboard.

Advantageously, the soundboard's boundary is free except in the three places 33, 35 and 37 where it is simply supported by the resonator tray. Free boundaries allow the soundboard to vibrate in a longer wavelength, thereby enabling lower frequencies of sound. In a rigid boundary the maximum wavelength in the soundboard is much smaller than in free boundaries, thus leading to higher frequencies of vibration. Simply supportive boundaries are somewhere in between. In this implementation of the invention, the three support locations 33, 35 and 37 were selected in order to minimize the spectral distance from this guitar to an acoustic guitar with a Sitka spruce simple resonator. The soundboard in this implementation is smaller than a typical acoustic guitar soundboard. By making the boundaries as free as possible, we minimize the acoustic effect of this difference in size.

Figure 3:
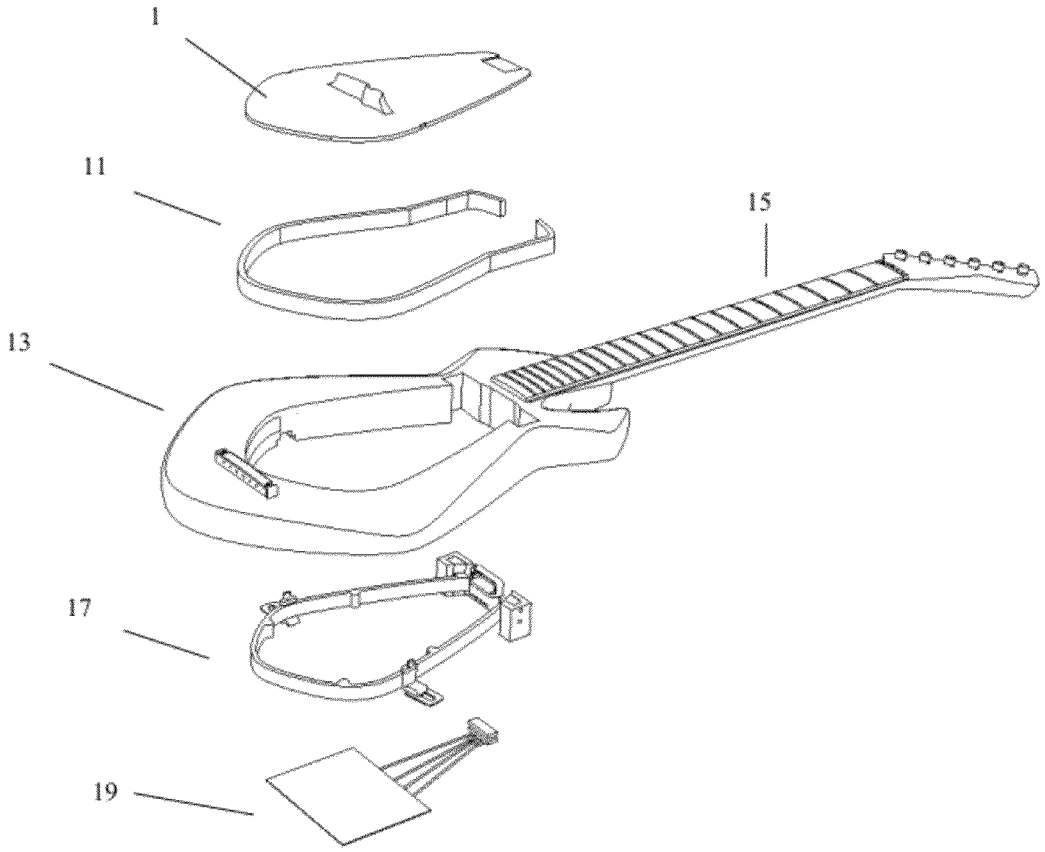
FIG. 3 is an exploded view of such guitar.

FIG. 3 is an exploded view of a guitar embodying principles of the invention. FIG. 3 shows a resonator 1, tailpiece 7, carbon fiber structure 11, body 13, neck 15, resonator tray assembly 17 and signal processing device 19. In an embodiment of this invention, the tailpiece 7 is a Gotoh° 510 tailpiece, available from Stewart-MacDonald, Athens, Ohio. The tailpiece anchors the strings to the body. The guitar body 13 is made from poplar wood. It is glued with epoxy to the guitar neck and to the carbon fiber structure. The neck 15 is comprised of mahogany wood, with an ebony fret board and 18% nickel-silver fretwire. It has a 25½ inch scale length, with 22 frets. The body 13 and mahogany portion of the neck 15 can be made using a CNC (computer numeric control) router, available from Shopbot Tools, Inc., Durham, N.C.

Figure 4:
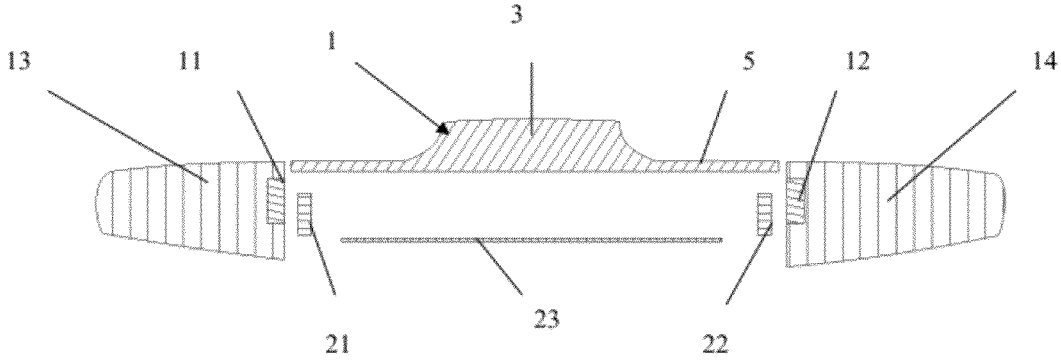
FIG. 4 is a cross sectional view of such guitar.

FIG. 4 is a cross sectional view of such guitar. It shows a resonator 1, comprised of a bridge 3 and soundboard 5. It also shows two sides of each of a carbon fiber structure 11, 12, a poplar body of the guitar 13, 14, and a resonator tray 21, 22. In addition, it shows a circuit board for a signal processing device 23.

The bridge 3 is an archtop bridge, comprised of rosewood with an inlaid bone saddle. The bridge is available as item 0192 from Stewart-MacDonald, Athens, Ohio. A cross-section of the carbon fiber structure 11, 12 (as shown in FIG. 4) is 15 mm×5 mm. The carbon fiber structure is glued to the poplar body 5 mm lower than the body's top surface (i.e., the surface closest to the strings). The carbon fiber structure adds stability and strength to the poplar body.

Figure 5:
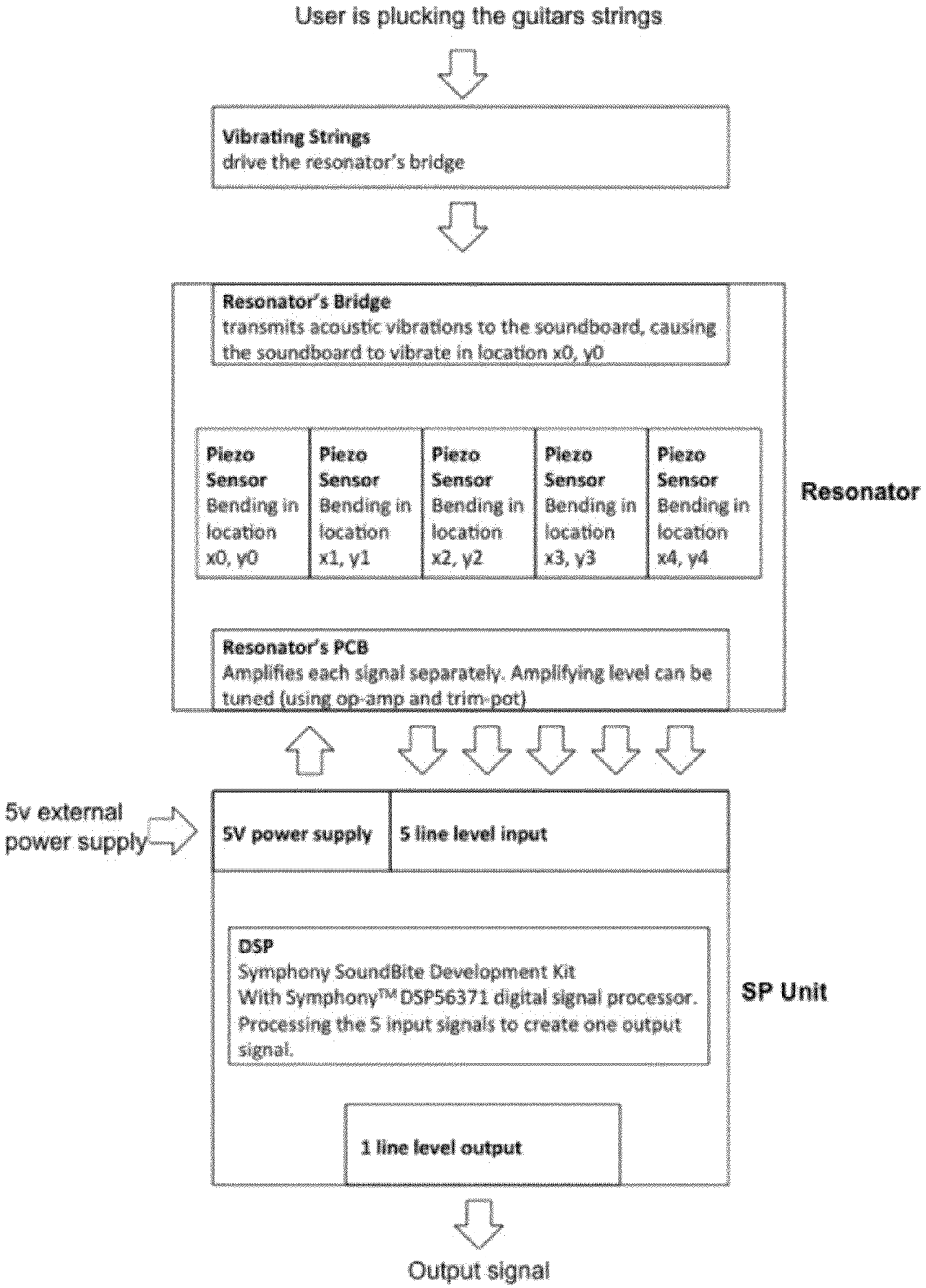
FIG. 5 is a flow chart illustrating the operation of an implementation of the invention.

FIG. 5 is a flow chart illustrating the operation of an implementation of this invention. The vibrating strings drive the resonator's bridge. The bridge transmits these vibrations to the soundboard, causing it to vibrate. Five piezoelectric sensors detect vibrations in the soundboard. The resonator includes a PCB (printed circuit board) that amplifies the signal from each sensor separately (using op-amp and trimming potentiometer apparatus). A SP (signal processing) device processes the five input signals to create one output signal.

It is an advantage of this invention that, in many implementations, the resonator may be easily inserted and removed through the back side of the musical instrument (i.e, the side opposite the strings). As a result, the resonator may be inserted and removed along a line or lines that do not pass through any plane defined by two or more of the instrument's strings. This is desirable because the strings do not need to be moved or loosened in order to insert and remove a resonator. The ease of insertion and removal makes it practicable to interchange different resonators.

Figure 6:
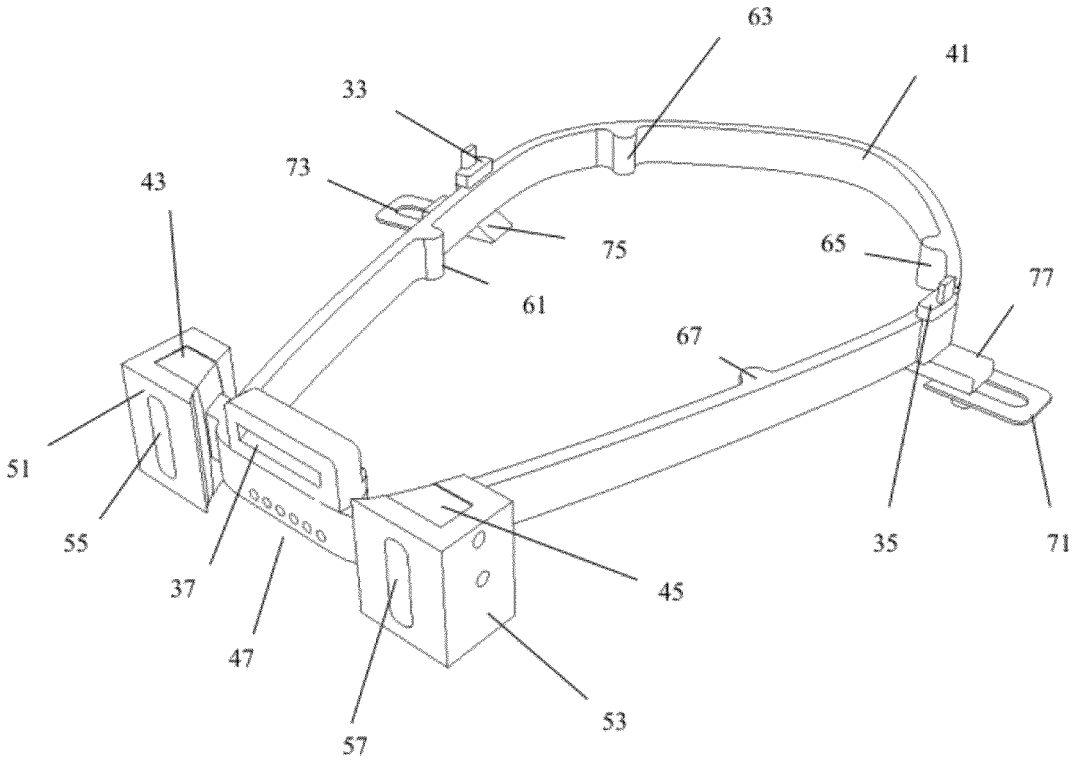
FIG. 6 is a perspective view of a resonator tray assembly for such guitar, embodying principles of the invention.
Figure 7:
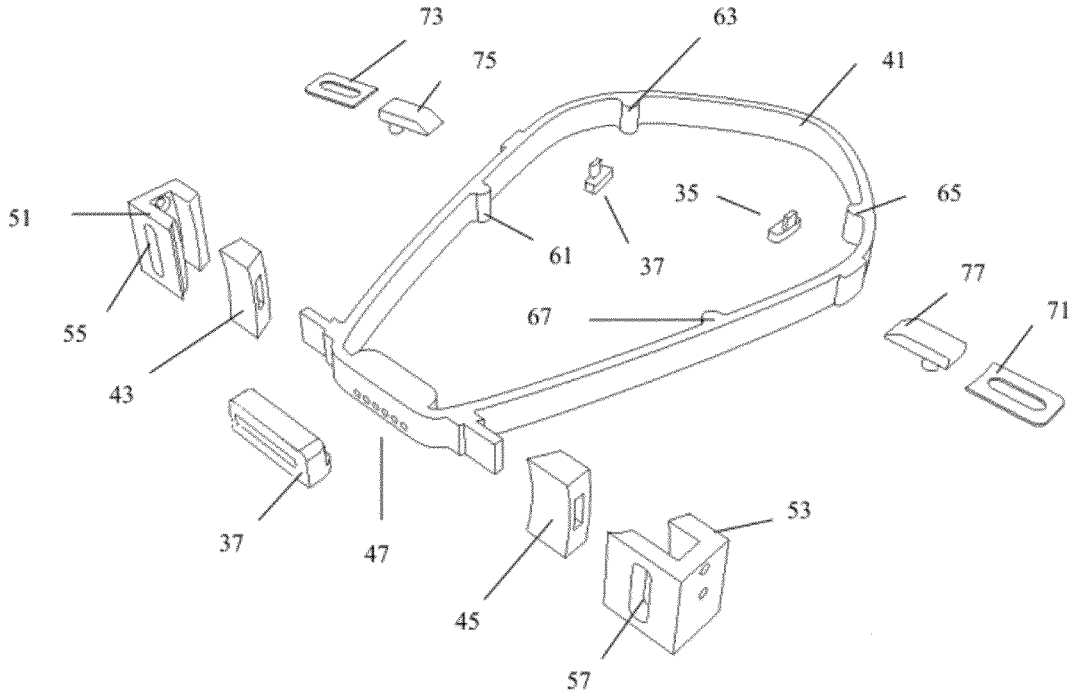
FIG. 7 is an exploded view of the resonator tray assembly.

FIG. 6 and FIG. 7 show a resonator tray for such guitar, embodying principles of the invention. FIG. 6 is a perspective view and FIG. 7 is an exploded view of that resonator tray. As illustrated in these two figures: The main part of the resonator tray is made of aluminum and comprises a frame 41, two slides 43, 45, and three supports 33, 35, 37 for the resonator. Holes 47 penetrate the frame. Through these holes pass wires for eight electrical connections to the SP Unit (five for signals from the five sensors, and the other three for a 5 v power supply to the resonator, a ground and a flag signal, respectively). Curved slides 43, 45 can slide, guided by curved rails 51, 53, respectively. Each of the rails 51, 53 is made of POM (polyoxymethylene). A steel screw is attached to each of the slides 43, 45. The screws slide within slots 51, 57 in the rails 51, 53. In each case, the screw cannot get past the ends of the slot, thereby preventing the slide from sliding out of the rail. The SP Unit is attached to the resonator tray with steel screws inserted into holes in the bottom of 61, 63, 65, 67. Two rails 71, 73 are made of aluminum. Two slides 75, 77 can slide, and are guided by two rails 71, 73. The two slides 75, 77 are made of POM and the two rails 71, 73 are made of aluminum. When the two slides 75, 77 are extended as shown in FIG. 6, they lock the resonator tray in place. Thus, slides 75, 77 and rails 71, 73 are locking mechanisms.

Figure 8:
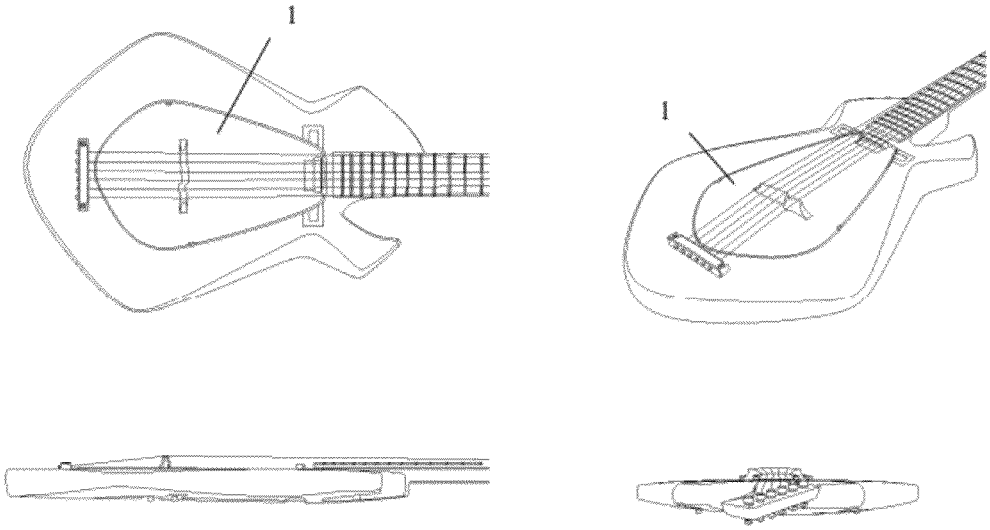
FIG. 8 illustrates such guitar, with the resonator inserted.
Figure 9:
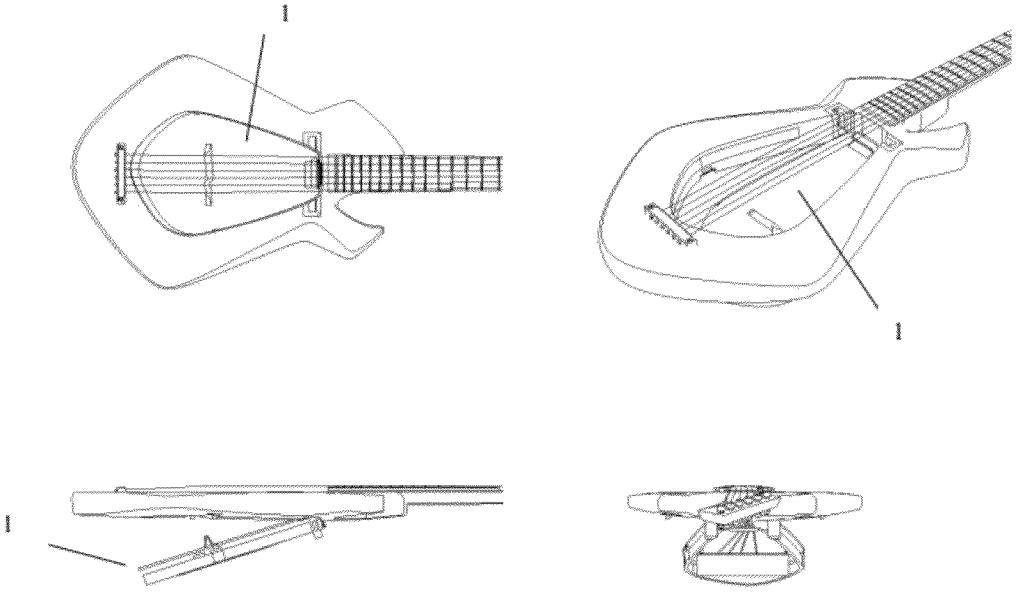
FIG. 9 illustrates such guitar, with the resonator tray open.
Figure 10:
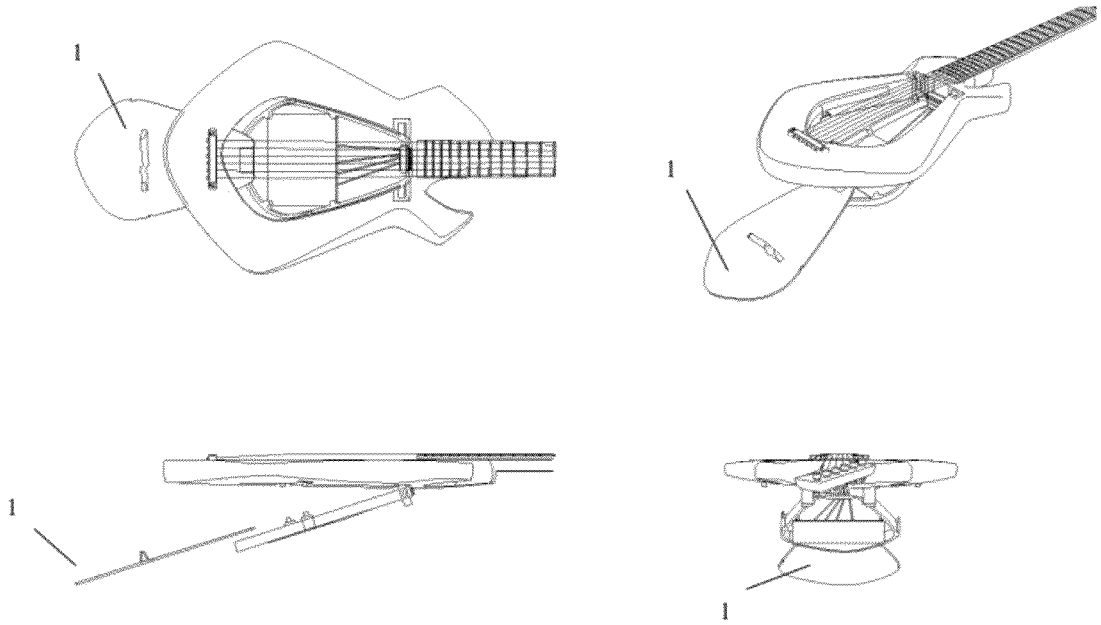
FIG. 10 illustrates such guitar, with the resonator tray open and the resonator removed.
Figure 11:
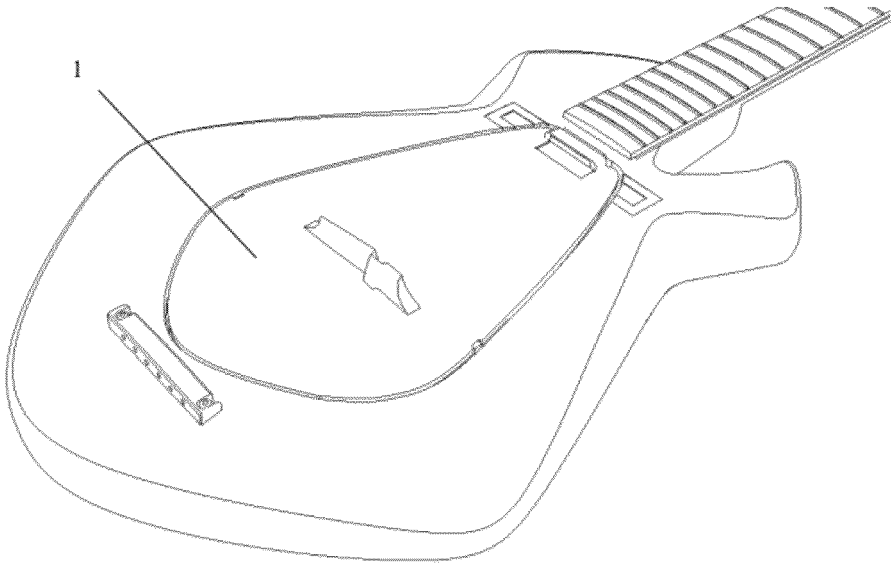
FIG. 11 is a perspective view of such guitar, with the resonator inserted.
Figure 12:
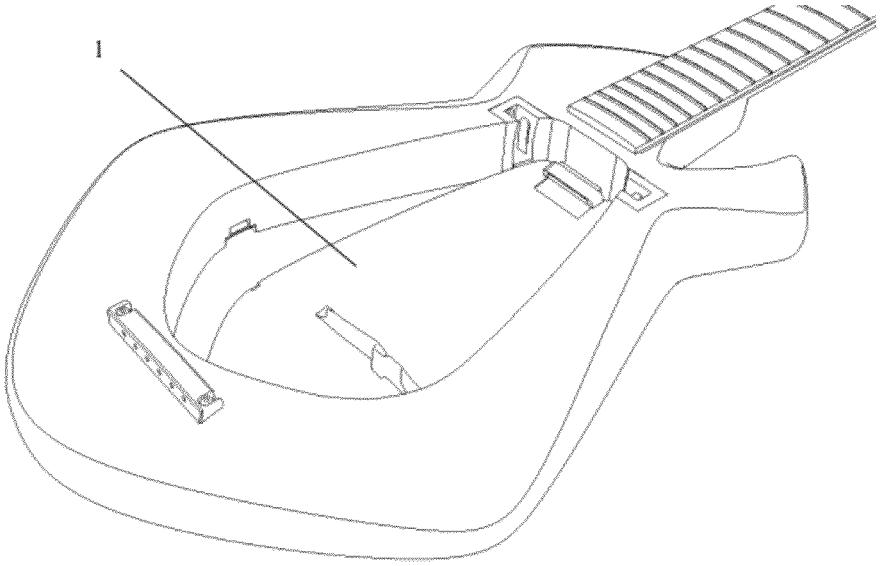
FIG. 12 is a perspective view of such guitar, with the resonator tray open.
Figure 13:
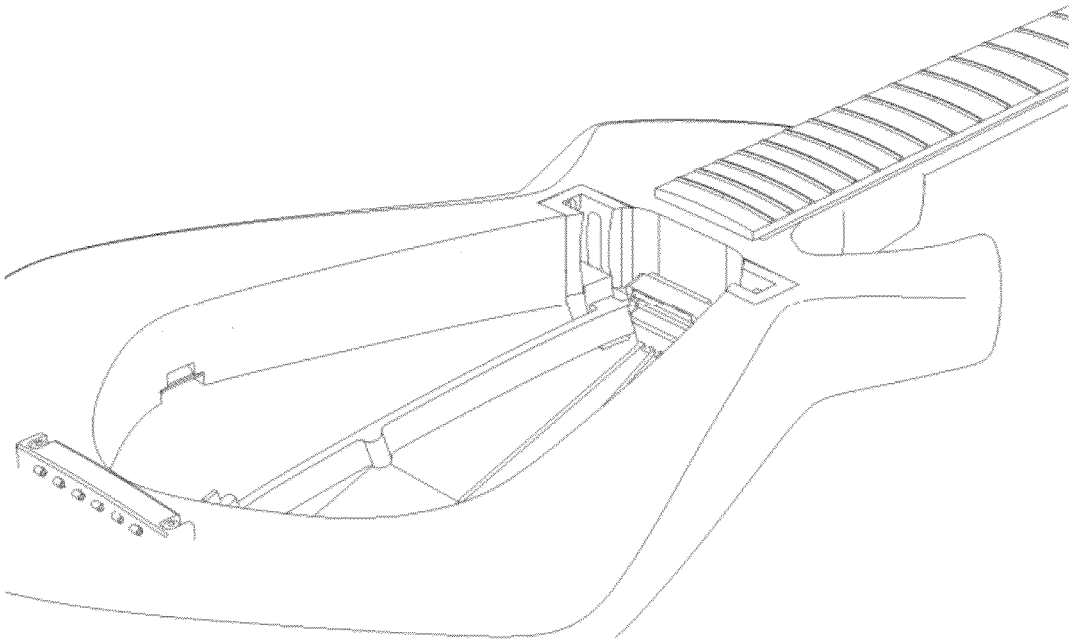
FIG. 13 is a perspective view of such guitar, with the resonator tray open and the resonator removed.
Figure 14:
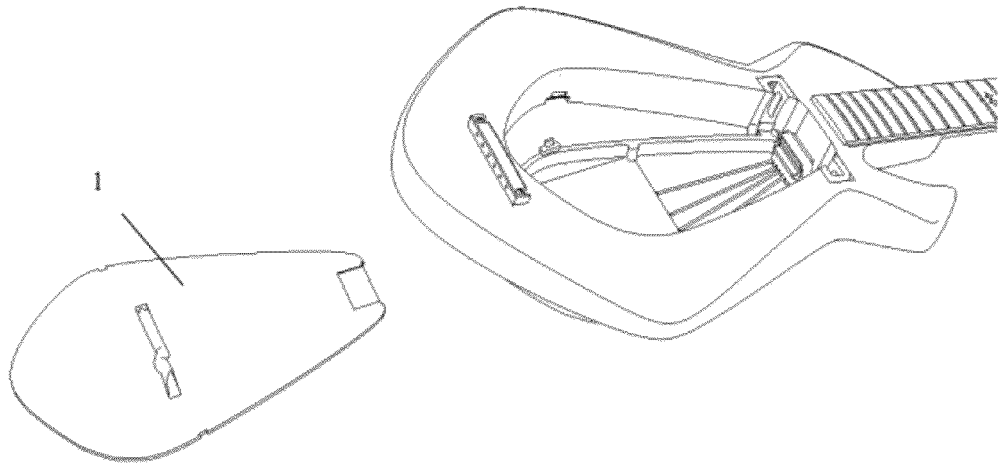
FIG. 14 is also a perspective view of such guitar, with the resonator tray open and the resonator removed.

The resonator tray can be slid open, allowing a resonator to be inserted and removed. Thus, the resonator tray enables one resonator to be interchanged for another. FIGS. 8 through 16 illustrate this. FIG. 8 and FIG. 11 show a guitar embodying principles of the invention, with resonator inserted and the resonator tray closed. FIG. 9 and FIG. 12 show that guitar, with the resonator tray slid open and the resonator still in the resonator tray. FIG. 10, FIG. 13 and FIG. 14 show that guitar, with the resonator tray slid open and the resonator removed from the guitar.

Figure 15:
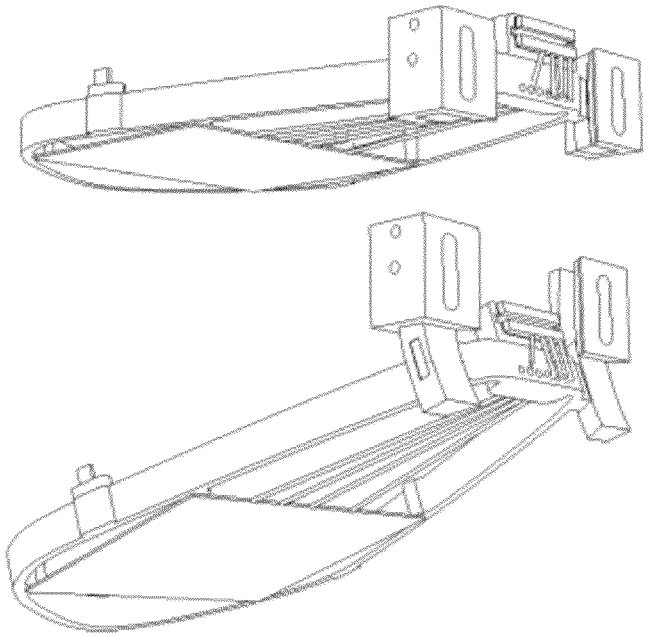
FIG. 15 consists of two perspective views of the resonator tray, the first showing the resonator tray in a closed position and the second showing the resonator tray in an open position.

FIG. 15 shows how curved slides 43, 45 and curved rails 51, 53 enable the resonator tray 41 to be slid open. In FIG. 15, the upper view shows the resonator tray in a closed position. The lower view shows the resonator tray in an open position.

Figure 16:
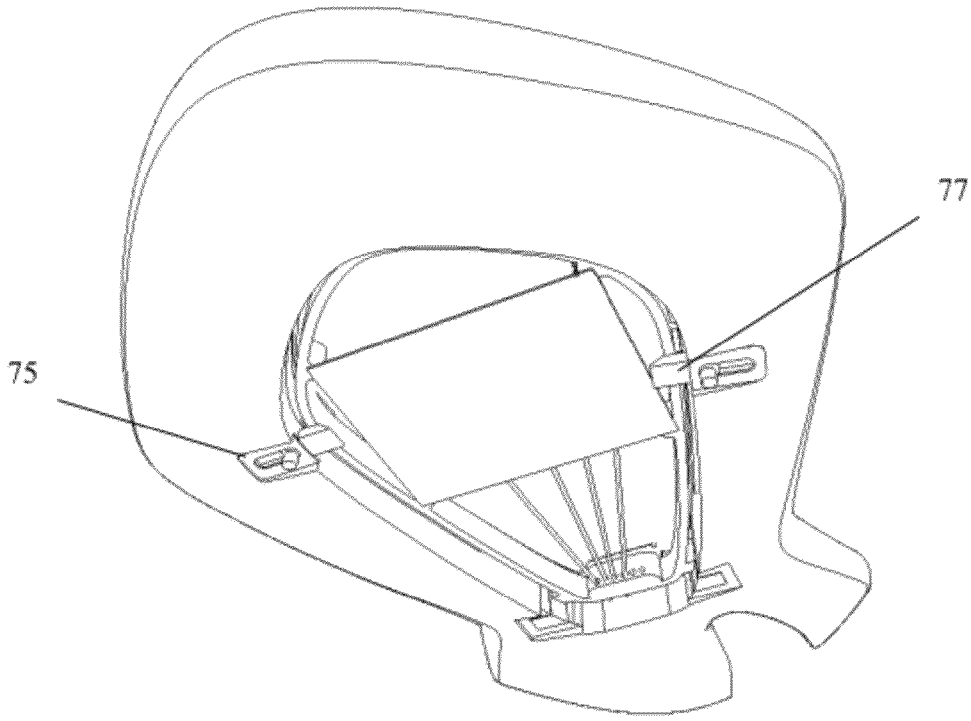
FIG. 16 is a perspective view of the bottom of a guitar embodying principles of the invention, with a locking mechanism in a "locked" position to hold the resonator tray closed.
Figure 17:
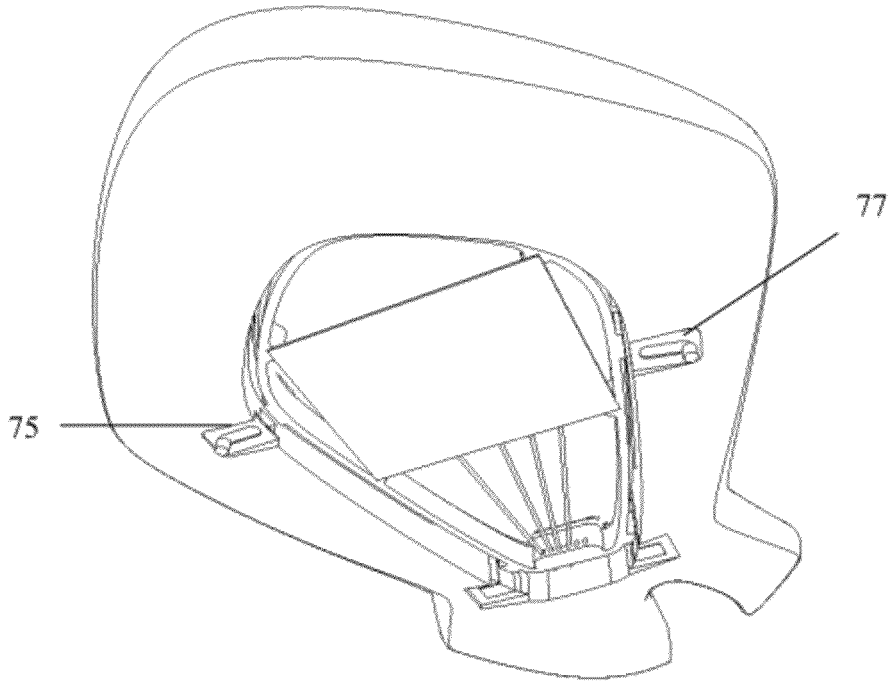
FIG. 17 is a perspective view of the bottom of such guitar, with a locking mechanism in a "unlocked" position to allow the resonator tray to be opened.

FIG. 16 is a perspective view of the back of such guitar. The two slides 75, 77 are extended so that the resonator tray is locked into position. FIG. 17 is also a perspective view of the back of such guitar. However, the two slides 75, 77 have been moved away from the resonator tray, into a position that allows the resonator tray to be opened.

Figure 18:
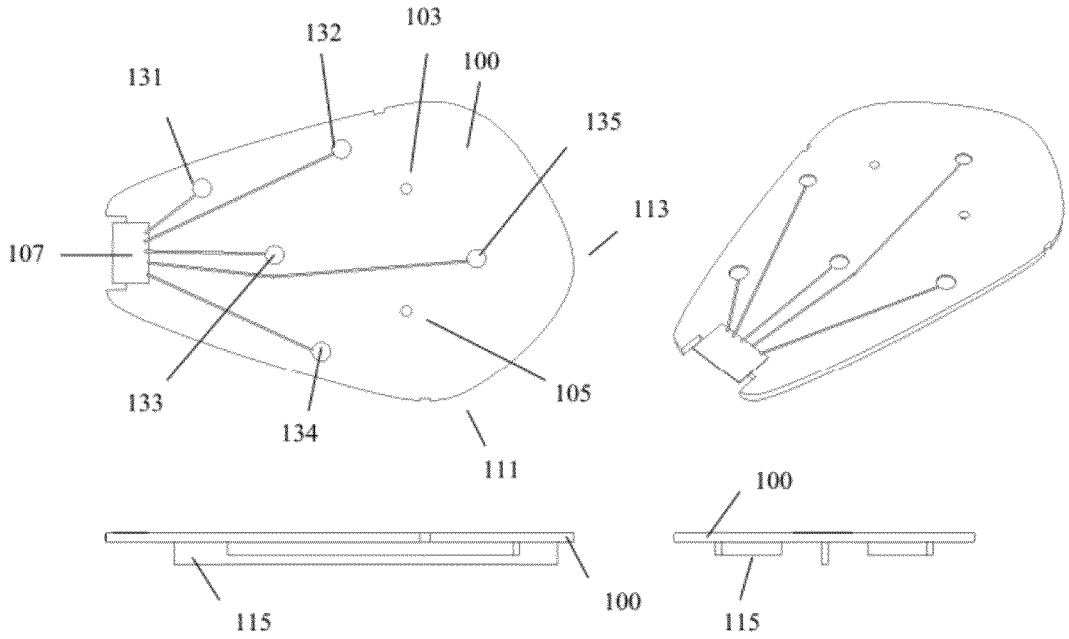
FIG. 18 illustrates one embodiment of a resonator for such guitar.
Figure 19:
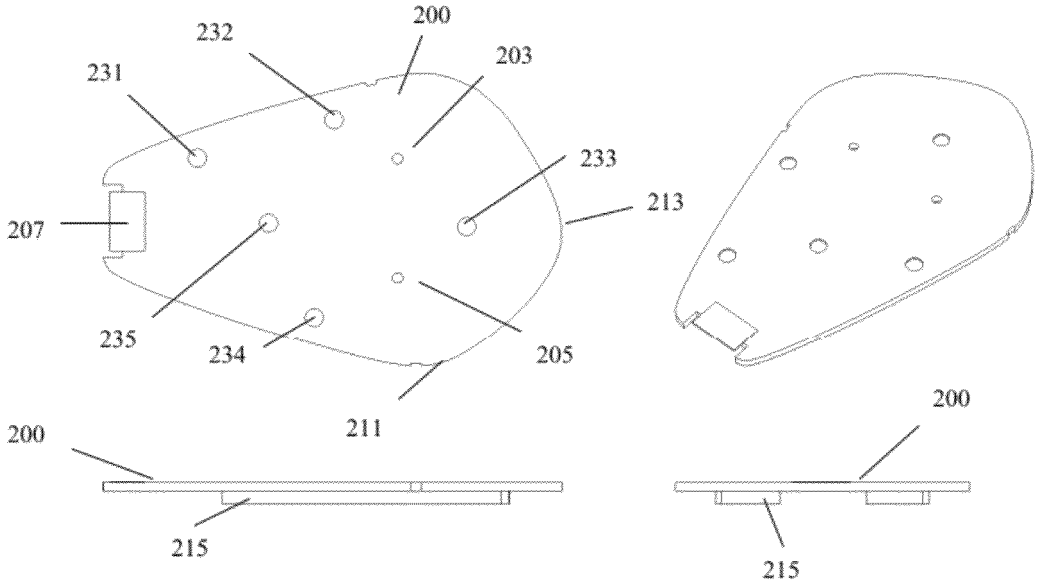
FIG. 19 illustrates a second embodiment of a resonator for such guitar.
Figure 20:
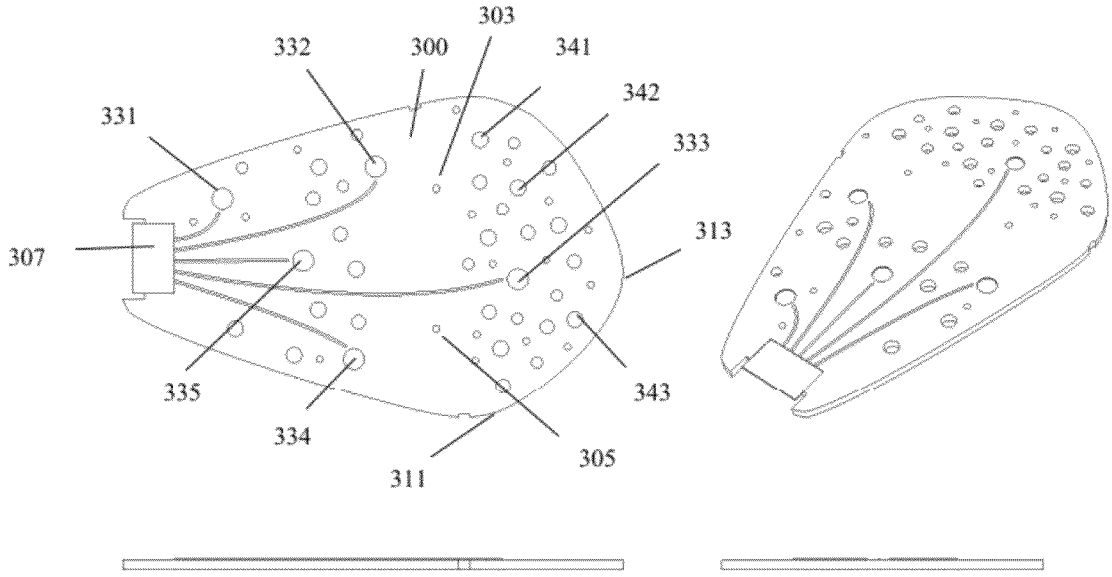
FIG. 20 illustrates a third embodiment of a resonator for such guitar.

FIGS. 18, 19 and 20 each illustrate different versions of a resonator, embodying principles of this invention. Each of these figures consists of four views, specifically (starting from upper left and going clockwise) a top view (viewed from above the strings), perspective view, side view (looking at the side of the resonator closest to 113, 213, 313) and another side view (looking at the side of the resonator closest to 111, 211, 311).

In each of these three figures (FIGS. 18, 19 and 20): A PCB (printed circuit board) 107, 207, 307 processes signals from sensors. The sensors are glued in place with an ethyl cyanoacrylate adhesive, such as Loctite® 380™ adhesive item 38004 available from Henkel Corporation, Rocky Hills, Conn. The soundboard has holes and the sensors are glued in place in these holes. When glued in position in these holes, the sensors do not extend past the top or bottom surface of the soundboard. Each sensor is connected to the PCB with two wires. One of the two wires is a ground wire that is not coated. The two wires are twisted together and covered with aluminum foil that touches the ground wire and shields the signal.

FIG. 18 illustrates one version of a resonator for such guitar. The soundboard 100 is 4 mm thick and is comprised of Western Red Cedar. Western Red Cedar is desirable because of its clarity of sound. Advantageously, five sensors are embedded in the soundboard 100 to detect vibrations in five locations of the soundboard. Four of them 131, 132, 133, 134 are piezoelectric sensors with the following specifications: 7000±600 Hz, 9.9 mm diameter×0.12 mm thick, Projects Unlimited part number AB1070B. The fifth of them 135 is a piezoelectric sensor with the following specifications: 2000±500 Hz, 27 mm diameter×0.23 mm thick, Projects Unlimited part number AB2720B. (Projects Unlimited, Dayton, Ohio). For each sensor, two twisted wires run between the sensor and the PCB. These wires are positioned in a 1.5 mm×1.5 mm slot that is indented in the top surface of the soundboard. The wires are covered with violin purfling. The total thickness of the two twisted wires, aluminum foil that covers them and the purfling is about 1 mm.

FIG. 19 illustrates a second version of a resonator for a guitar embodying principles of this invention. The soundboard 200 is comprised of Sitka Spruce. This material is available as item 4662 Grade AAA spruce, from Stewart-MacDonald, Athens, Ohio. Sitka Spruce is desirable because it is tonally vibrant and has a high tensile strength. The soundboard is 2 mm thick. The thinness of the soundboard gives it more low frequencies than a thicker soundboard, such as the 4 mm soundboard shown in FIG. 18. The Sitka Spruce is also stiffer and denser than cedar. As a result, this spruce soundboard damps sound less than the cedar soundboard described above. Advantageously, five sensors 231, 232, 233, 234, 235 are embedded in the soundboard 200 to detect vibrations in five locations of the soundboard. Each is a piezoelectric sensor with the following specifications: 7000±600 Hz, 9.9 mm diameter×0.12 mm thick, Projects Unlimited part number AB1070B (Projects Unlimited, Dayton, Ohio). For each sensor, two twisted wires run between the sensor and the PCB. These wires are positioned in slots, in the same manner as described for FIG. 19, except that the wires are covered with wood putty, rather than violin purfling.

FIG. 20 illustrates a third version of a resonator for such guitar. The soundboard 300 is comprised of maple. Maple is stiffer than cedar or spruce. As a result, the sound is quieter, with less low frequencies. Advantageously, there are numerous holes of varying sizes in the soundboard, for example, holes 341, 343. Screws of different sizes (to fit the different sized holes) may be inserted into or removed from these holes, thus adding or removing mass from specific locations in the soundboard. Such a change in the number or location of screws influences the vibration modes of the soundboard and changes its acoustic spectrum. By inserting or removing screws in this fashion, the sound produced by the resonator may be adjusted. Advantageously, five sensors 331, 332, 333, 334, 335 are embedded in the soundboard 300 to detect vibrations in five locations of the soundboard. Each is a piezoelectric sensor with the following specifications: 4100±500 Hz, 15 mm diameter×0.2 mm thick, Projects Unlimited part number AB1541 (Projects Unlimited, Dayton, Ohio). For each sensor, two twisted wires run between the sensor and the PCB. These wires are positioned in slots covered by violin purfling, in the same manner as described in FIG. 18.

In the resonators shown in FIGS. 18, 19 and 20, the rosewood bridge is attached to the soundboard with two screws are inserted into two holes 103, 105, 203, 205, 303, 305. The rosewood bridge adds stiffness to the resonator.

In some implementations, bracing is attached on the underside of the soundboard to add strength. In FIG. 18, the soundboard is strengthened with braces 115 comprised of maple. In FIG. 19, the soundboard is strengthened with braces 215 comprised of mahogany. No bracing is attached to the maple soundboard in FIG. 20, because maple has a high strength.

This invention may be implemented with a PCB in or attached to the soundboard. For example, in FIG. 18, the "on soundboard" PCB buffers signals from five sensors, amplifies them in order to achieve an amplitude range of zero to five volts, and then transmits the five separately amplified signals to a SP (signal processing) device. Thus, the PCB allows the SP device, which is not on the soundboard, to be agnostic as to the type and amplitude of the sensors on the soundboard.

Figure 21:
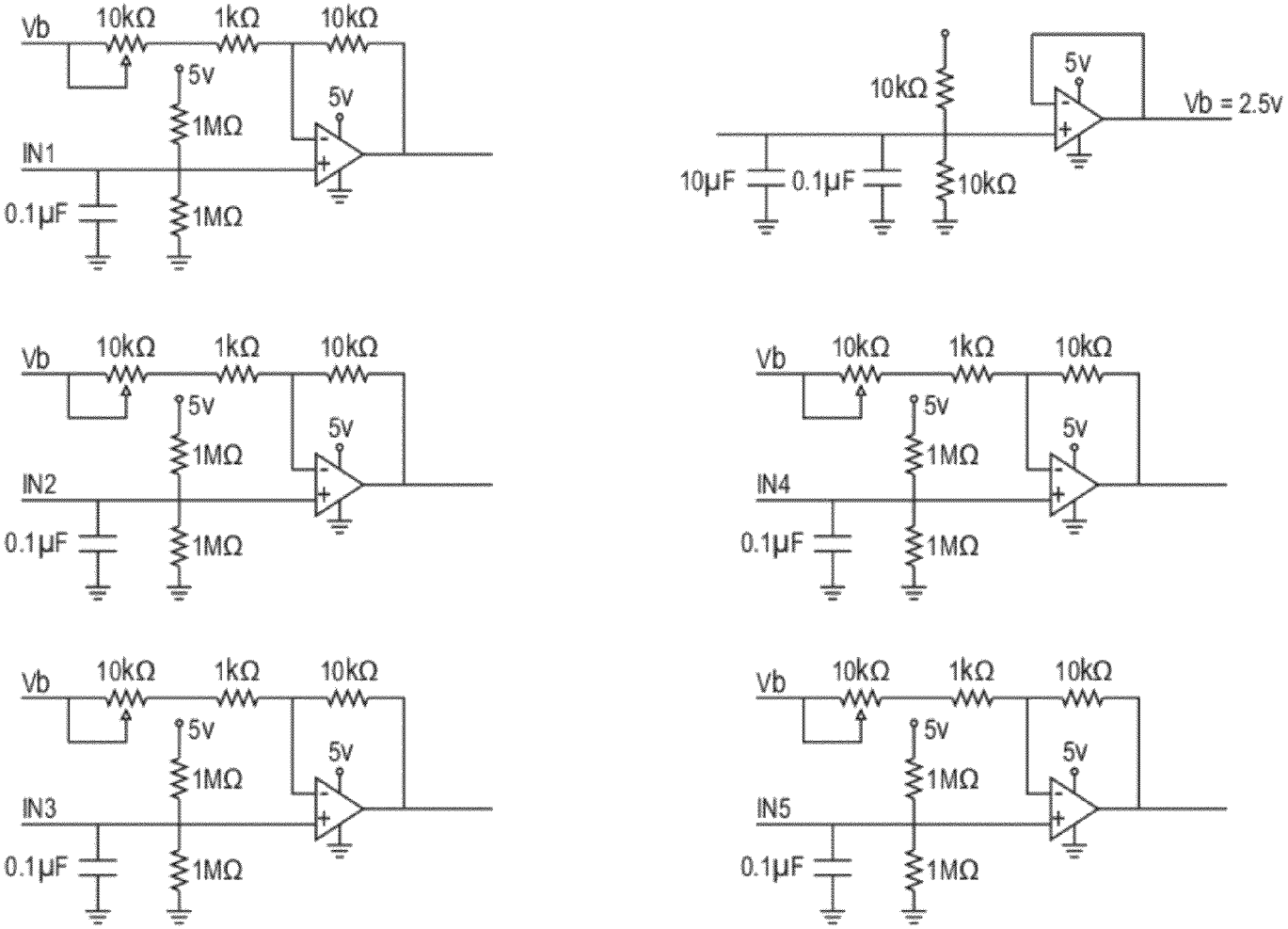
FIG. 21 is a circuit diagram for a PCB (process control block), embodying principles of the invention.

FIG. 21 is a circuit diagram of such a PCB, embodying the principles of this invention. The printed circuit board of the PCB plugs into connectors available as parts 70ADJ-5-ML1 and 70ADJ-3-ML1, from Bourns, Inc., Riverside, Calif. (8 contacts total). Therefore, this two-layer PCB has extended output pins on the edges to each signal line and power line. The thickness of the PCB is 31 mm.

Figure 22:
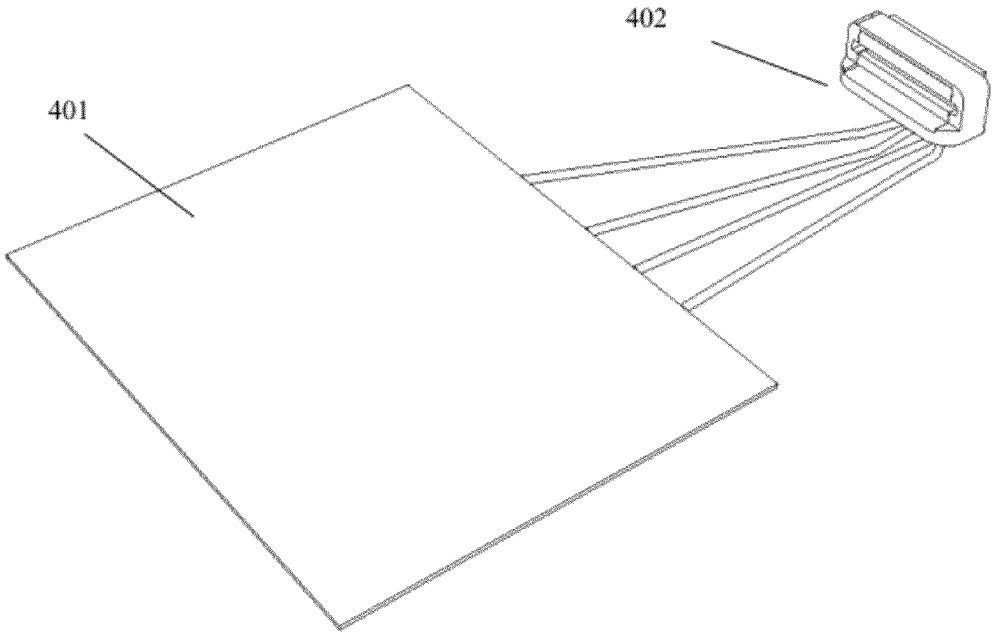
FIG. 22 illustrates a signal processing device with electronic connectors for such guitar.

FIG. 22 shows a circuit board 401 for a SP (signal processing) device for use in a guitar, embodying the principles of this invention. The SP device is embedded in, or located in or on, or attached to, the musical instrument. Electronic connectors 402 provide connectors for transmitting input signals to and output from this circuit board. In this implementation, the SP device receives five line level (0-5 v) input signals, processes them, and outputs one line level (0-5 v) output signal. The SP device may be analog or digital. Alternately, the musical instrument does not have an "onboard" SP device. In this alternative version, the instrument transmits signals reflective of vibrations measured by the sensors to a separate SP device at a distance from the instrument, which SP device is not a part of the instrument.

Figure 23:
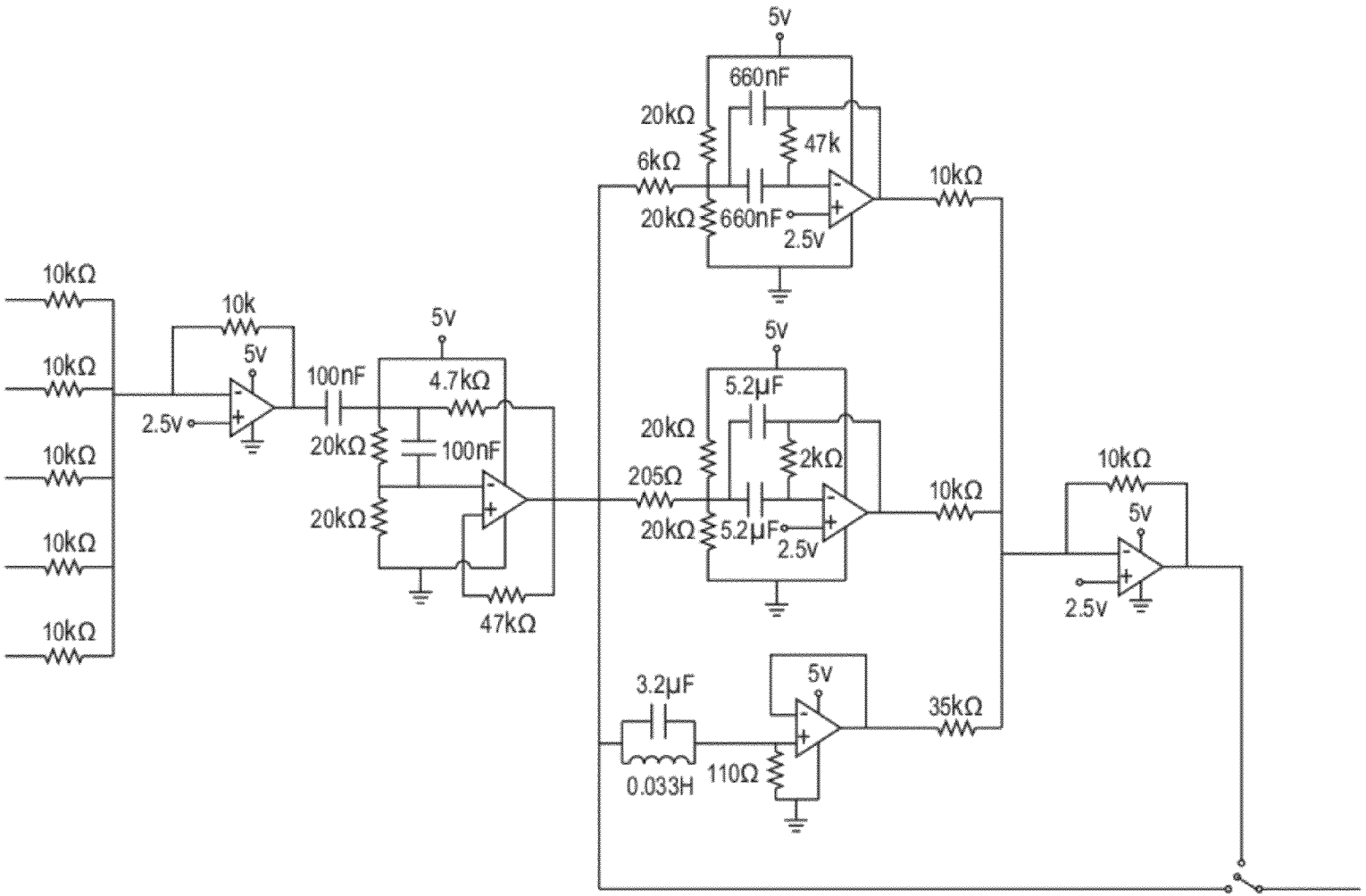
FIG. 23 is a circuit diagram for analog processing of signals from sensors of such guitar, embodying principles of the invention.

The analog version of the SP device may be a linear processing device. In one analog implementation, the SP device combines five input signals into one unified signal and then filters this signal to minimize the error from a conventional acoustic guitar spectrum (amplifying 110 Hz and 220 Hz and attenuating 500 Hz). FIG. 23 is a circuit diagram of an analog implementation of the SP device.

A digital version of the SP device may be implemented using a 24-bit digital signal processor (DSP). For example, such a digital version may be implemented using a 24-bit Symphony™ DSP56371 digital signal processor, together with the Symphony™ SoundBite Development Kit, each available from Freescale Semiconductor, Inc., Austin, Tex.

The algorithms for the DSP (digital signal processor) may be comprised of three conventional processing layers: First, analyzing the continuous displacement of the resonator (surface interpolation, based on wave equation of the input from the sensors). Second, changing the boundary condition of the resonator and implementing a virtual chamber. Third, implementing a virtual microphone.

Figure 24:
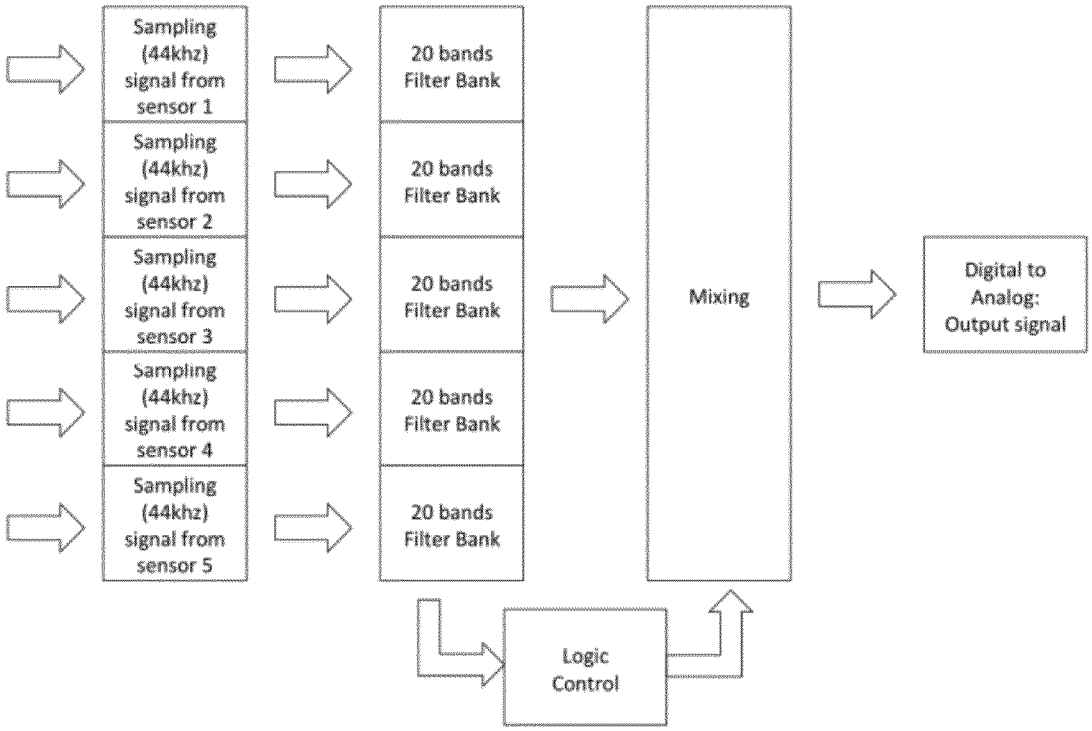
FIG. 24 is a schematic diagram of a DSP (digital signal processing) audio algorithm, embodying principles of the invention.

Alternatively, the signals may be manipulated using a conventional DSP audio algorithm, without the need to model a virtual chamber. FIG. 24 is a schematic illustrating an implementation of this alternate approach.

In audio and digital versions of the SP device, conventional parametric equalizers may be used for each of the signals arriving from the sensors. These equalizers employ IIR (infinite impulse response) filters with SOS type (second order sections).

Alternately, this invention may implemented with a variety of conventional signal processing approaches, including subtractive synthesis, frequency or phase modulation, granular synthesis, Karplus-Strong, filter bank, and finite element. These approaches may be used to take advantage of the fact that, in many implementations, we have multiple acoustics signals from the same experience. By using these approaches, multiple, rich acoustics signals may be combined with digital or analog signal processing, Alternately, other digital signal processor hardware may be used, such as an ADSP-TS201S TigerSHARC® processor from Analog Devices, Inc., Norwood, Mass., or a TMS320C672x floating point DSP from Texas Instruments, Dallas, Tex.

The SP device has a mono audio output that is sent with a standard audio wire to an amplifier or other transducer that is not part of the musical instrument. Alternately, the output signal may be wirelessly transmitted to such an amplifier or other transducer.

This invention gives the user great flexibility to adjust the acoustic qualities of the soundboard. These adjustments are achieved by changing physical characteristics of the soundboard. This physical flexibility complements the flexibility and control made possible with signal processing.

For example, some implementations of this invention include apparatus for adding or removing mass at one or more points of the soundboard (such as by inserting screws into holes in the soundboard or by removing such screws, as described with respect to FIG. 20). Alternately, other masses could be used, instead of a screw. Or other fasteners may be used to attach the mass to the soundboard, instead of threads for a screw. The addition or removal of mass from a soundboard in different locations changes the acoustic qualities of the soundboard.

Also, for example, some implementations of this invention include apparatus for adjusting a boundary condition (e.g., rigidly supported, simply supported or free) of at least one point of a soundboard. For example, rail apparatus may be positioned below the soundboard near the soundboard's edge, so that a block riding the rail may simply support the boundary of the soundboard, and the block may be moved on the rail, thereby adjusting where this simple support is provided. The block and rail apparatus may be comprised of precision guide blocks and rails, with part numbers that start with "6709K", available from McMaster-Carr Supply Company, Elmhurst, Ill. Alternately, adjustable cantilevers at a particular location on the soundboard boundary may be moved toward the soundboard into a position that simply supports the soundboard at that point, and moved away from the soundboard to leave the soundboard free at that point. Or, for example, the resonator tray may include clamps located at various places. These clamps, when closed, exert pressure on the top and bottom surfaces of the soundboard at the boundary of the soundboard. When such a clamp is closed, this pressure creates a rigid boundary condition at the location where such pressure is exerted. Alternately, a wedge may be inserted between the boundary of the soundboard and another part of the musical instrument. When the wedge is so inserted, it may exert pressure on the soundboard's boundary, causing the boundary condition to be rigid at the area of contact with the wedge. In some implementations, adjustment apparatus may create a wide variety of boundary conditions, in addition to the freely vibrating, simply supported and rigid conditions discussed above. For example, a particular soundboard may have apparatus for changing the support of the soundboard at one or more locations to pinned, rocker, roller, ball, cable in tension, frictionless surface, frictionless collar or guide, or a rough surface. Adjustment of boundary conditions changes the acoustic qualities of the soundboard. For example, a rigid boundary condition tends to result in less low frequencies.

Some implementations of this invention include apparatus for adjusting the composition of at least one part of the soundboard. For example, in some implementations, the soundboard includes at least one hollow chamber into which different materials may be put and removed. For example, a liquid such as water or oil, or a solid such as rice kernels, may be put into the chamber. Not only the type of material, but also the amount of material, in the chamber may be adjusted. Alternately, a soundboard may include apparatus for removing a portion of a soundboard and replacing it with a similarly shaped portion of different composition. Thereby, for example, a portion of the soundboard made of spruce may be removed and replaced with a portion made of mahogany. Alternately, the soundboard may include apparatus for adding and removing springs to the soundboard, which vibrate differently than the surrounding material of the soundboard. By adjusting the material composition of the soundboard, the acoustic qualities of the soundboard may be changed.

Different braces may be used to strengthen the soundboard, in addition to those shown in FIGS. 18 and 19. For example, brace configurations similar to a fan or "X" may be used, and braces of different materials may be employed. Also, some implementations of this invention include apparatus (such as screw holes, screws and a variety of different brace shapes and materials) for adjusting the position of, or for inserting and replacing, at least one brace 215. For example, in some implementations of this invention, a soundboard 200 in FIG. 19 has screw holes in different locations, and each brace 215 is held in position by screws inserted into such soundboard. By removing such screws (so that a brace is no longer attached to the soundboard) and inserting these screws in a different screw holes (so that a brace is reattached to the soundboard), the position of the brace may be adjusted. Adjustment of any brace changes the acoustic qualities of the soundboard.

Figure 25:
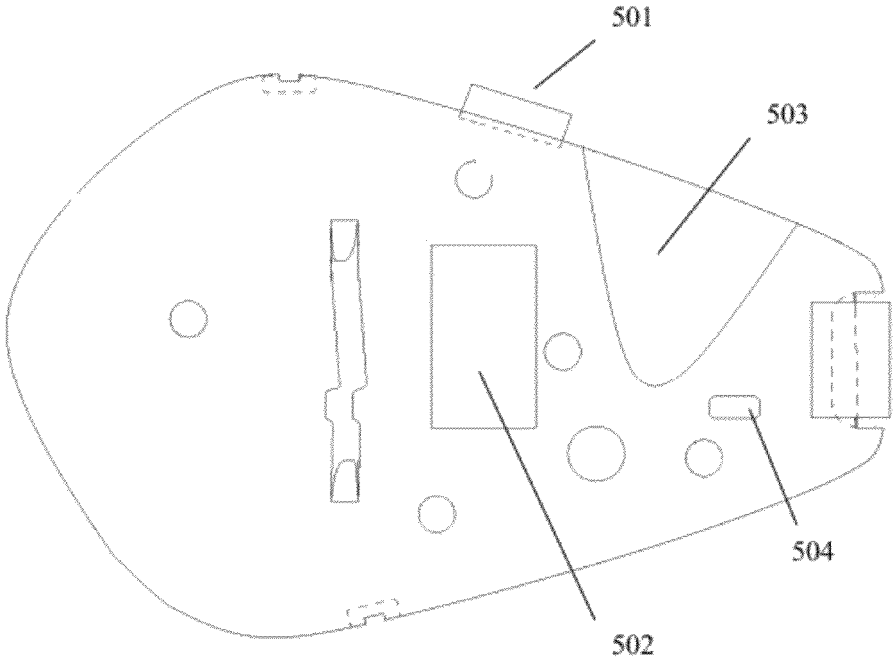
FIG. 25 is a top view of a resonator for a guitar, embodying principles of this invention.

FIG. 25 is a top view of a resonator embodying the principles of this invention. As shown in FIG. 25, physical characteristics of such resonator may be adjusted. FIG. 25 shows a block 501 that is part of a block and rail system as described above and that simply supports an area at the boundary of a soundboard. It also shows the top 502 of a hollow chamber that can hold various materials, such as water, oil or rice kernels. It also shows a portion 503 of a soundboard that may be removed and interchanged with another portion of the same shape but a different material. It also shows the top 504 of a slot in the soundboard for holding a spring.

In addition to adjusting the physical characteristics of a particular soundboard, this invention teaches that flexibility may also be achieved by removing a particular soundboard and replacing it with another soundboard with different physical features. Thus, in an implementation of this invention, the resonator is removable and different resonators may be interchanged for a single instrument.

Advantageously, each soundboard is physically unique. For example, in a wooden soundboard, the exact pattern of wood grain, density and material is unique. Thus, for example, when a highly compressed piece of spruce from an old wooden bridge in New England is used as the soundboard, it creates a unique sound. By interchanging resonators, a single instrument may express a wide variety of unique sounds.

A variety of different approaches may be used to remove and replace a resonator. It is desirable in many cases to do this through the back side of the instrument, so that the strings do not need to be removed or loosened to get the resonator in and out of the instrument. Thus, FIGS. 11, 12, 13 and 14 teach an approach in which the resonator is removed from the back side of the instrument (i.e., the side opposite the strings) using a slide and rail mechanism to open the resonator tray. Alternately, the resonator tray may be opened with a hinge mechanism. Or the resonator may simply be held in place by a removable part of the back side of the instrument. When this removable part of the back side is removed, the resonator may be inserted or withdrawn from the instrument. When this removable part of the back side is locked into the instrument, it holds the resonator in place. Alternately, the resonator may be removed from any side of the instrument, including the front (string) side. For example, the tailpiece may be removable. In that case, the tailpiece can be removed and the strings, which are attached to the tailpiece, can be moved out of the way, enabling the resonator to be inserted or removed through the front plane of the instrument.

Advantageously, this invention teaches that the size of the resonator may be reduced to less than the size of the soundboard in a conventional acoustic instrument. For example, in a guitar embodying the principles of this invention, the soundboard may be reduced to a size far smaller than that of a conventional acoustic guitar. In that case, the soundboard may be too small on its own to create a sound similar to an acoustic guitar, but the SP device can be used to compensate for that difference, so that the ultimate output sounds like an acoustic guitar. A smaller resonator helps reduce the overall weight and size of an instrument, and also makes it easier to insert or remove the resonator.

In some embodiments of this invention, the bridge is connected to the soundboard and is part of the resonator. However, this invention can be implemented with a bridge that is separate from the resonator. An advantage of such an approach is that the resonator can be flat and smaller (because it does not include the bridge), thereby making it easier to insert and remove.

In an instrument embodying the principles of this invention, the various parts of the instrument may be made from materials other than those described above. For example, the body of a guitar embodying the principles of this invention may be advantageously comprised of maple, metal (such as aluminum or steel), carbon fiber, or a synthetic polymer such as poly(methyl methacrylate), sold under the brand names R-CAST® or LUCITE®. Alternately, the body may be comprised of ceramic, glass, or plastic. Also, for example, the neck of such a guitar may be advantageously comprised of maple. Also, for example, instead of wires, conductive glue can be placed on the soundboard to act as leads from the sensors to the PCB.

This invention may be implemented with different types of sensors for measuring vibrations in the soundboard, including piezoelectric sensors, pressure sensors or magnetic sensors. In implementations of this invention, a plurality of sensors measure primarily the vibrations of a soundboard. However, these may be used together with other sensors that measure primarily vibrations of other objects such as strings.

Illustrations have been given above of a guitar that embodies the principles of this invention. However, this invention applies to any musical instrument with one or more strings, including instruments in which strings are caused to vibrate by bowing, plucking, striking, rubbing or air movement. For example, this invention may be implemented in any member of the violin family. Violins, like the guitar illustrated above, have strings that push against the bridge but are not connected to it. For example, in an implementation of this invention, a violin has a removable resonator comprised of a bridge and soundboard. The violin strings exert force against the bridge, tending to hold the resonator in position against a resonator tray assembly. In this implementation, multiple sensors sample vibrations in different locations of the violin's soundboard, and signals from these sensors are processed with a signal processing device located within the violin.

Also, for example, this invention may implemented for a piano. For example, this invention may be implemented with a piano that has at least one bridge, at least one soundboard, and, for each soundboard, a plurality of sensors for measuring vibrations of such soundboard. In such implementation, the piano also has at least one signal processing device, located in or attached to the piano, for processing input signals from said sensors. With this invention, a sufficiently small soundboard may be used so as to allow for removal and replacement of a piano soundboard. This allows another soundboard, with different physical characteristics and tonal qualities, to be inserted into the piano. Alternately, apparatus may be used to adjust the physical characteristics of a particular piano soundboard. For example, a piano soundboard may be adjusted with apparatus for changing the material composition, boundary conditions or bracing of the soundboard or for adding or removing mass at different locations on the soundboard, in the manner described above.

This invention may also be implemented for a stringed instrument that does not conventionally have a soundboard. According to the principles of this invention, a soundboard would be added to the instrument and, in many implementations, would be removable.

CONCLUSION

It is to be understood that the methods and apparatus which have been described above are merely illustrative applications of the principles of the invention. Numerous modifications may be made by those skilled in the art without departing from the scope of the invention. The scope of this invention is limited only by the claims that follow.

What is claimed is:

1. A stringed musical instrument comprising, in combination:

at least one removable resonator comprised of:

a soundboard, simple supports for simply supporting the soundboard, and a plurality of sensors for sampling vibrations of the soundboard at different points of the soundboard, which plurality comprises at least three sensors, and at least one analog or digital signal processing device, for processing signals from the plurality of sensors, which signal processing device is embedded within the stringed musical instrument.

2. The stringed musical instrument of claim 1, in which the stringed musical instrument is a guitar or a member of the violin family.

3. The stringed musical instrument of claim 1, in which the resonator is further comprised of a bridge adapted for directly or indirectly transmitting vibrations of strings of the stringed musical instrument to the soundboard.

4. The stringed musical instrument of claim 3, in which the resonator, when installed in the stringed musical instrument, is held in place by pressure exerted directly or indirectly by the strings.

5. The stringed musical instrument of claim 4, further comprising apparatus for inserting and removing a resonator through the back side of the stringed musical instrument along a line or lines that do not pass through any plane defined by two or more of the strings.

6. The stringed musical instrument of claim 1, further comprising apparatus for adjusting a boundary condition of the soundboard by moving the simple supports on a rail.

7. The stringed musical instrument of claim 1, wherein the soundboard has a material composition, and the soundboard further comprises a hollow cavity into which different materials may be inserted and removed in order to change the material composition.

8. The stringed musical instrument of claim 7, wherein the hollow cavity is adapted to hold liquid.

9. A musical instrument comprising, in combination:

at least one string, a soundboard, simple supports for simply supporting the soundboard, apparatus for transmitting vibrations of the at least one string to the soundboard, a plurality of sensors for measuring primarily vibrations of the soundboard, which plurality comprises at least three sensors, and a signal processing device located in or on such musical instrument, for receiving input signals from the plurality of sensors reflective of such vibrations, processing such input signals, and outputting signals reflective of audio data.

10. The musical instrument of claim 9, in which the musical instrument is a guitar, a member of the violin family or a piano.

11. The musical instrument of claim 9, in which at least one of the plurality of-sensors is a piezoelectric sensor.

12. The musical instrument of claim 9, further comprising apparatus for inserting and removing a resonator through the back side of the musical instrument.

13. The musical instrument of claim 12, wherein the at least one string comprises two or more strings, and wherein the apparatus for inserting and removing a resonator is adapted so that insertion and removal of the resonator is through the back side of the musical instrument along a line or lines that do not pass through any plane defined by said two or more strings.

14. The musical instrument of claim 9, wherein the apparatus for transmitting vibrations of the at least one string comprises an archtop bridge.

15. The musical instrument of claim 9, further comprising apparatus for adjusting a boundary condition the soundboard of the soundboard by moving the simple supports on a rail.

16. The musical instrument of claim 9, wherein the soundboard has a material composition, and the soundboard further comprises apparatus for changing the material composition.

17. The musical instrument of claim 9, wherein a printed circuit board for amplifying signals from the plurality of sensors is located in or attached to the soundboard.

18. The stringed musical instrument of claim 17, wherein the resonator may be interchanged with another resonator.

19. The stringed musical instrument of claim 17, wherein the instrument is a piano.

20. A stringed musical instrument comprising, in combination:

a resonator comprised of a bridge, a soundboard, simple supports for simply supporting the soundboard, and a plurality of sensors for measuring vibrations of such soundboard, and at least one signal processing device, located in or attached to said stringed musical instrument, for processing input signals from said plurality of sensors.

* * * * *